United States Patent [19]

Foerster

[11] 4,328,631

[45] May 11, 1982

[54] CARD-RACK ASSEMBLY

[75] Inventor: Gerhard A. Foerster, Woodbridge, Conn.

[73] Assignee: Pyramid Technologies, Inc., Meriden, Conn.

[21] Appl. No.: 222,931

[22] Filed: Jan. 6, 1981

[51] Int. Cl.[3] ..... G09F 1/10

[52] U.S. Cl. ..... 40/373; 40/124.2; 211/55

[58] Field of Search ..... 40/373, 374, 375, 382, 40/383, 490, 491, 489, 195, 124, 124.2, 124.4, 156; 211/55, 54.1, 56, 128; 312/183, 193

[56] References Cited

U.S. PATENT DOCUMENTS

| | | | |
|---|---|---|---|
| 2,302,771 | 11/1942 | Hobby . | |
| 2,872,185 | 2/1959 | Kropp | 40/124.2 |
| 2,981,019 | 4/1961 | Baird . | |
| 3,428,186 | 2/1969 | Michel . | |
| 3,465,460 | 9/1969 | Dahl | 40/383 |
| 3,691,664 | 9/1972 | Stoian . | |
| 3,958,697 | 5/1976 | Brown et al. | 211/54.1 |
| 4,041,631 | 8/1977 | Stevens . | |
| 4,077,520 | 3/1978 | Stevenson . | |
| 4,244,129 | 1/1981 | Foerster et al. | 40/124.2 |

*Primary Examiner*—Gene Mancene
*Assistant Examiner*—John J. Wilson

[57] ABSTRACT

A card rack includes parallel pairs of coplanar fins that extend inwardly from side walls whose spacing is adjustable. The inner edges of the coplanar fins are spaced apart so as to provide a passage for an elongated stop member that extends through all the compartments. Holes in tabs at both ends of the stop member receive self-tapping screws. The threaded portions of the screws engage opposed faces of upper and lower pairs of fins to secure the stop member in place. The screws can be loosened to slide the stop member along the upper and lower compartments and thereby adjust the depth of all the compartments.

8 Claims, 6 Drawing Figures

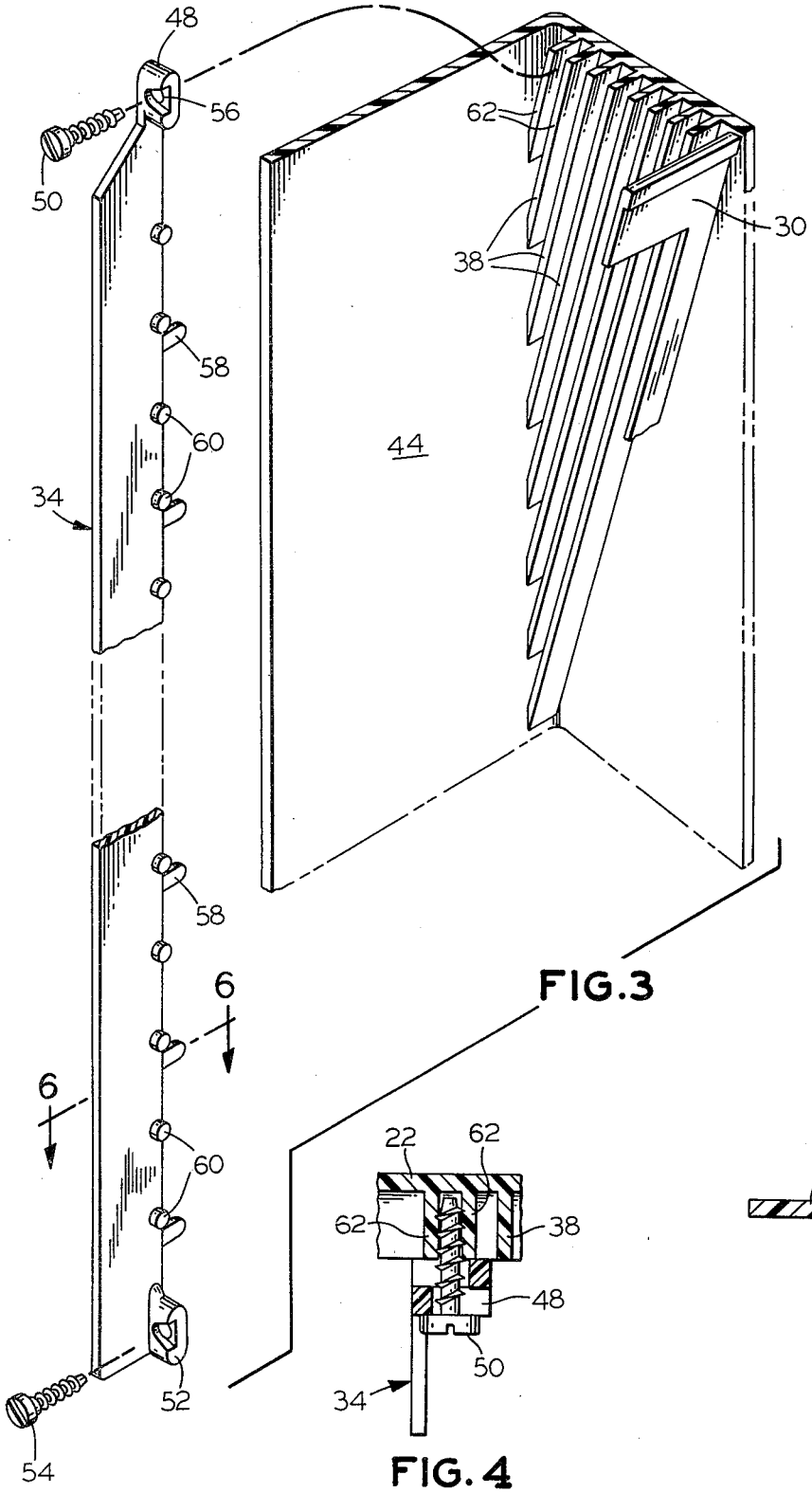
FIG.3
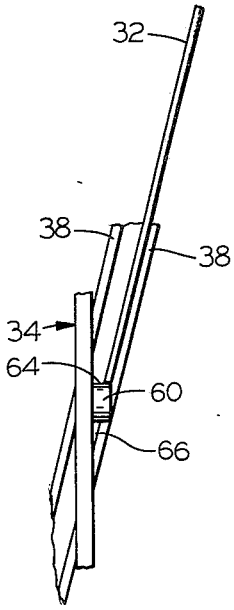
FIG.5
FIG.4
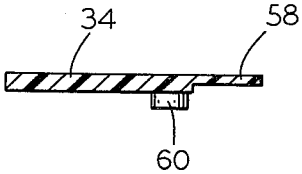
FIG.6

CARD-RACK ASSEMBLY

BACKGROUND OF THE INVENTION

The present invention relates to card racks, particularly those of the type in which the depth of the compartments for receiving the cards is adjustable.

United States Patent Application Ser. No. 49,472, filed on June 18, 1979, now U.S. Pat. No. 4,244,129, by Foerster et al., discloses a card rack in which a stop member extends through apertures in the compartment dividers to determine the depth of the compartments. Each divider has a number of apertures aligned with those through the other dividers so that the compartment depth can be changed by changing the apertures through which the stop member extends.

The present invention is a further development of the device described in the Foerster et al. application and employs an arrangement that affords continuous, rather than discrete, adjustment of compartment depth.

SUMMARY OF THE INVENTION

The foregoing and related objects are achieved in a card-rack assembly including a pair of elongated spaced-apart side walls, each of which provides first and second longitudinally extending edges. The first and second edges lie generally in first and second substantially parallel planes, respectively. The card-rack assembly further includes means supporting the side walls in opposed, spaced relationship and a multiplicity of substantially parallel divider portions supported between the side walls at an acute angle to the common plane. The side walls and the surfaces of adjacent divider portions form card compartments, at least a plurality of which are open toward the first common plane. The card-rack assembly is thereby permitted to be mounted with the common planes extending vertically and the divider portions inclined downwardly from the first common plane toward the second common plane to permit cards to be received at the first common plane in the open card compartments.

According to the present invention, each of the divider portions has an aperture in it at least partly aligned with the apertures in the other divider portions to provide a passage extending through the compartments, and the card-rack assembly further includes an elongated stop member and means for mounting it. The stop member is disposed in the passage and extends through the compartments substantially parallel to the first common plane to limit the depth to which cards can be inserted into the compartments. The passage is of substantially greater dimension than the stop member so that substantial movement of the stop member toward and away from the first common plane is permitted. The mounting means extends between and engages opposed faces of at least a pair of adjacent divider portions. It supports the stop member in the passage to provide a compartment depth determined by the position at which the opposed faces are engaged by the mounting means. The mounting means is releasable to permit the stop member to be moved in the passage toward and away from the first common plane and is re-engageable with the opposed faces of the pair of adjacent divider portions to mount the stop member at different positions. The depth of the compartments to which cards can be inserted is thereby adjustable to any value within a limited range.

Each of the divider portions preferably includes a pair of coplanar fins extending inwardly from opposite side walls, the inner edges of the fins being spaced apart to provide the aperture in the divider portion. The stop member may include a plurality of longitudinally spaced fingers extending into the spaces between adjacent fins to prevent substantial rearward bending of the stop member under the weight of cards received in the compartments. Also, the mounting means may include mounting tabs at both ends of the stop member and a self-tapping screw associated with each mounting tab. Each mounting tab would have an aperture through which the associated self-tapping screw extends into the space between adjacent fins to engage the opposed faces of the fins with the threaded portion of the screw. In the illustrated embodiment, the compartments in which the self-tapping screws are received are closed toward the first common plane to prevent reception of cards in the compartments receiving the screws.

The card-rack assembly depicted in the drawings is comprised of first and second halves. The first half includes the first side wall and the fins extending from it. The first half further includes a first back wall extending inwardly from the first side wall at its second edge and lying approximately in the second common plane. The second half of the card-rack assembly includes the second side wall and the fins extending from it and further includes a second back wall extending inwardly from the second side wall at its second edge and lying approximately in the second common plane. The first and second back walls are offset to permit them to overlap and slide across each other for adjustment of the spacing of the side walls. Also included is a releasable fastener means for maintaining the spacing of the side walls. The spacing of the side walls is permitted to be adjusted when the fastener means is loosened.

The stop member may advantageously include a boss disposed in each of the open compartments and providing a surface for supporting the lower edge of a card received in the open compartment.

BRIEF DESCRIPTION OF THE DRAWINGS

These and further features and advantages of the present invention are described with reference to the accompanying drawings, in which:

FIG. 3 is a perspective view, partly broken away, of the stop member and the right half of the card-rack assembly of FIG. 1;

FIG. 4 is a section taken at line 4—4 with parts broken away;

FIG. 5 is a detailed side elevation of a pair of fins of the card rack of FIG. 1, the stop member being shown in the proper position for support of a card; and FIG. 6 is a section taken at line 6—6 of FIG. 3.

DETAILED DESCRIPTION OF THE PREFERRED EMBODIMENT

Figure 1:
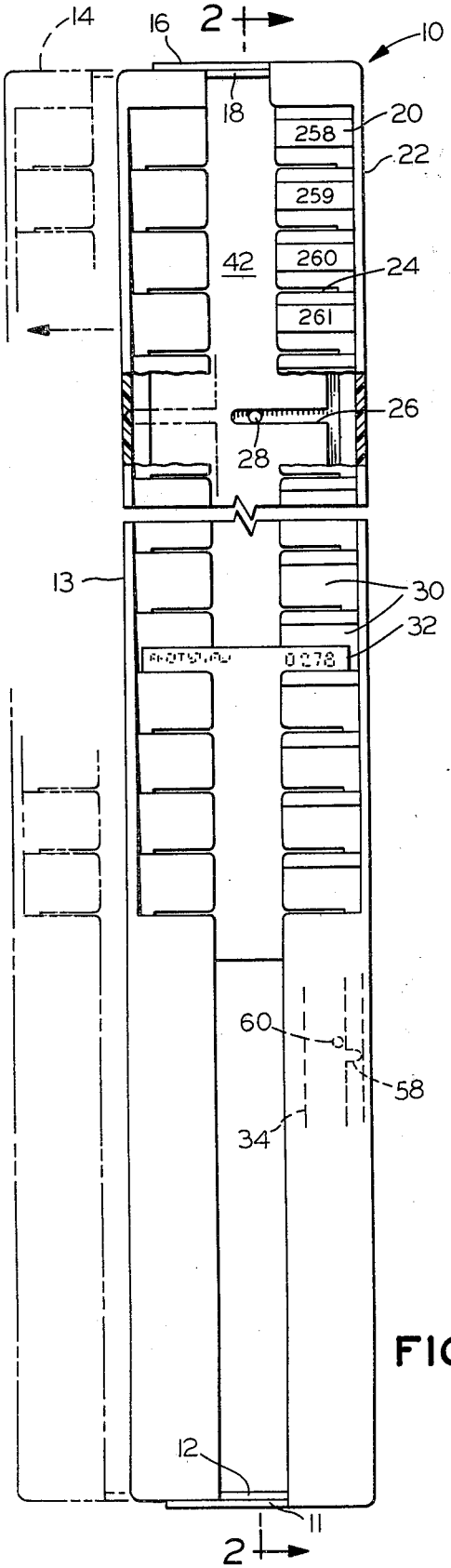
FIG. 1 is a front elevation of a card rack that follows the teachings of the present invention.
Figure 2:
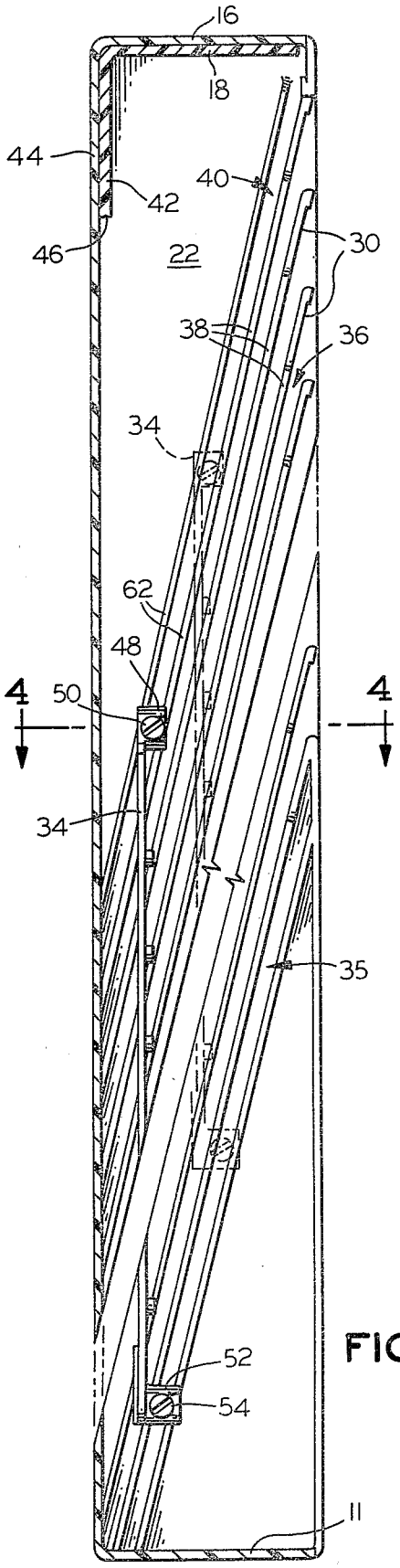
FIG. 2 is a sectional view taken at line 2—2 of FIG. 1.

The drawings show various aspects of the card-rack assembly illustrated in FIG. 1 as having right and left halves. The right half includes a bottom wall 11, a top wall 16, and a side wall 22. The left half includes a bottom wall 12, a side wall 13, and a top wall 18. Openings 24 in the front face of the card rack are provided by which cards are received in compartments 36 (FIG. 2)

formed by fins 38 (FIG. 3) projecting from both side walls. The width of the card rack can be adjusted by varying the separation of the side walls, as phantom 14 of FIG. 1 suggests, and a stop member 34 (FIGS. 2 and 3) is mounted in the passage between opposed fins to determine the depth to which cards can be inserted. Adjustment of separation of the stop member from the front face permits compartment depth to be varied.

A detailed inspection of FIG. 1 reveals that top and bottom walls 16 and 11 of the right half overlap top and bottom walls 18 and 12 of the left half so that they can slide along each other to vary the separation between left wall 13 and right wall 22. For the same reason, rear walls 42 and 44 also overlap, as FIG. 2 shows. It can be seen in FIG. 1 that rear wall 42 of the left half provides a slot 26 that registers with a hole 28 in the rear wall 44 of the right half. These provisions are made to accommodate a conventional fastener, not shown in the drawings, that holds the two halves in place. The fastener can be loosened to allow adjustment or compartment width.

Part of the front face of the card rack is formed by a number of tabs 30 extending from both side walls and leaving openings 24 between them that afford access to the compartments. It may be desirable to have numerical legends such as legend 20 on these tabs to facilitate proper location of the cards to be contained in the rack.

The depth of the rack, as was mentioned before, is determined by the position of a stop member, seen in dashed lines in FIG. 1 but illustrated more clearly in FIG. 2. FIG. 2 is a section taken at lines 2—2 of FIG. 1 with the left rear wall 42 broken away at 46 for clarity. Simultaneous reference to FIGS. 2 and 3 reveals that the compartments are formed by pairs of adjacent fins extending inwardly from side walls 13 and 22 and oriented at an acute angle to the plane of the front of the card rack. Each fin 38 on one of the side walls is coplanar with a similar fin on the opposite side wall. The inner edges of coplanar fins are separated even at the smallest permitted separation of the side walls so that coplanar fins act as divider portions of the card rack with an aperture formed by the inner edges of the fins. These apertures are aligned to provide a passage in which stop member 34 is mounted.

Stop member 34 is an elongated, substantially planar member that lies in a plane generally parallel to the front face of the rack. At the upper and lower ends of stop member 34 are mounting tabs 48 and 52, respectively, which are oriented generally perpendicular to the plane of the stop member and form apertures through which self-tapping screws 50 and 54 extend. As can be seen most clearly in FIG. 4, self-tapping screw 50 extends through the aperture in tab 48 and into the space between two fins, where it engages opposing faces 62 of the fins with its threaded portion. Self-tapping screw 54 is similarly engaged with opposing faces of adjacent fins, and it is in this manner that the stop member is held in place.

Inspection of FIG. 2 reveals that screws 50 and 54 are received in the uppermost and lowermost compartments 40 and 35, respectively. Unlike the other compartments 36, which are open at their front ends, compartments 35 and 40 do not have openings by which access is permitted from the front of the card rack. Accordingly, cards are not permitted in the compartments that receive the screws.

It is apparent that adjustment is easily achieved by loosening screws 50 and 54 and sliding stop member 34 along compartments 35 and 40 to the desired height. When the desired compartment depth is achieved, the screws are again tightened, and stop member 34 is again held securely in place.

As can be seen from the drawings, stop member 34 may be provided as a rather thin plastic part. With such a thin part, there may be a tendency for stop member 34 to bend backward under the weight of a large number of cards. In order to prevent this bending and still employ a fairly thin stop member, a number of fingers 58 (FIGS. 3 and 6) are provided along the length of stop member 34. These fingers extend into the spaces between some of the adjacent fins 38 when stop member 34 is mounted by means of screws 50 and 54. These fingers 58 lend rigidity to stop member 34 because the interference of fins 38 with fingers 58 prevents stop member 34 from bending backward substantially. Of course, it would be possible to employ other teachings of the present invention without the use of fingers 58, but it is believed that they will be found desirable for card racks of any substantial height because their use permits the stop member to be a fairly thin piece.

In the embodiment illustrated in the drawings, the edge of stop member 34 abuts the edges of fins 38. The result of this abutment, as FIG. 5 indicates, is that a corner 66 is formed between stop member 34 and fin 38. Just above corner 66 in each compartment is provided a small boss 60 on stop member 34 that has an upper surface on which a card 32 rests. Boss 60 prevents card 32 from being wedged into corner 66.

Of course, bosses 60 are not absolutely necessary, and the problem that they remedy could obviated somewhat by spacing stop member 34 from the fins. However, it is thought that the close spacing of the fins and stop member is desirable when fingers 58 are employed. Also, although a spacing of stop member 34 from fins 38 could, depending on the spacing, prevent cards from being stuck between the stop member and the fins, it can be anticipated that some cards will be shoved rather forcefully into the compartments, and, in the absence of bosses on stop member 34, bending of the cards could result. Provision of the bosses is therefore desirable.

It is apparent from the foregoing description that a card rack can be constructed by following the teachings of the present invention that is sturdy yet light in weight and readily moldable. It also provides enhanced depth adjustability so that a single construction can be used on cards of a wide range of sizes.

Having thus described the invention, I claim:

1. In a card-rack assembly including a pair of elongated spaced-apart side walls, each of which provides first and second longitudinally extending edges, said first and second edges lying generally in first and second substantially parallel planes, respectively, said card-rack assembly further including means supporting said side walls in opposed, spaced relationship and a multiplicity of substantially parallel divider portions supported between said side walls at an acute angle to said common plane, said side walls and the surfaces of adjacent divider portions forming card compartments, at least a plurality of said compartments being open toward said first common plane, said card-rack assembly thereby being permitted to be mounted with said common planes extending vertically and said divider portions inclined downwardly from said first common plane toward said second common plane to permit cards to be received at said first common plane in said card compartments of said open plurality thereof, the improvement wherein:

a. each of said divider portions has an aperture therein with said apertures of said divider portions being aligned at least in part to provide a passage extending through said compartments; and b. said card-rack assembly further includes:

(i) an elongated stop member disposed in said passage and extending through said compartments substantially parallel to said first common plane to limit the depth to which cards can be inserted into said compartments, said passage being of substantially greater dimension than said stop member to permit substantial movement of said stop member toward and away from said first common plane; and (ii) mounting means extending between and engaging opposed faces of at least a pair of adjacent divider portions and supporting said stop member in said passage to provide a compartment depth determined by the position at which said opposed faces are engaged by the mounting means, said mounting means being releasable to permit said stop member to be moved in said passage toward and away from said first common plane, said mounting means further being re-engageable with said opposed faces of said pair of adjacent divider portions to mount said stop member at different positions, the depth of said compartments to which cards can be inserted thereby being adjustable to any value within a limited range.

2. The card-rack assembly of claim 1 wherein each of said divider portions includes a pair of coplanar fins extending inwardly from opposite side walls, the inner edges of said fins being spaced apart to provide said aperture in said divider portion.

3. The card-rack assembly of claim 2 wherein said stop member includes a plurality of longitudinally spaced fingers extending into the spaces between adjacent fins to prevent substantial rearward bending of said stop member under the weight of cards received in said compartments.

4. The card-rack assembly of claim 3 wherein said mounting means includes tabs at both ends of said stop member and a self-tapping screw associated with each mounting tab, each mounting tab having an aperture therethrough through which said associated self-tapping screw extends, each self-tapping screw extending into the space between adjacent fins and engaging the opposed faces of said fins with the threaded portion of said screw.

5. The card-rack assembly of claim 4 wherein the compartments in which said self-tapping screws are received are closed toward said first common plane to prevent reception of cards in said compartments receiving said screws.

6. The card-rack assembly of claim 3 wherein said stop member includes a boss thereon disposed in each of said open compartments and providing a surface for supporting the lower edge of a card received in said open compartment.

7. The card-rack assembly of claim 2 wherein said card-rack assembly includes first and second halves thereof, said first half including said first side wall and said fins extending therefrom, said first half further including a first back wall extending inwardly from said first side wall at said second edge thereof and lying approximately in said second common plane, said second half of said card-rack assembly including said second side wall and said fins extending therefrom and further including a second back wall extending inwardly from said second side wall at said second edge thereof and lying approximately in said second common plane, said first and second back walls being offset to permit them to overlap and slide across each other for adjustment of the spacing of said side walls, said card-rack assembly further including releasable fastener means for maintaining the spacing of said side walls, the spacing of said side walls being permitted to be adjusted when said fastener means is loosened.

8. The card-rack assembly of claim 2 wherein said stop member includes a boss thereon disposed in each of said open compartments and providing a surface for supporting the lower edge of a card received in said open compartment.

* * * * *

UNITED STATES PATENT AND TRADEMARK OFFICE

CERTIFICATE OF CORRECTION

PATENT NO. : 4,328,631

DATED : May 11, 1982

INVENTOR(S) : Gerhard A. Foerster

It is certified that error appears in the above—identified patent and that said Letters Patent is hereby corrected as shown below:

Column 6, line2, after "includes" insert -- mounting --

Signed and Sealed this

First Day of March 1983

[SEAL]

*Attest:*

GERALD J. MOSSINGHOFF

*Attesting Officer*

*Commissioner of Patents and Trademarks*